US009899749B2

(12) United States Patent
Kondou

(10) Patent No.: US 9,899,749 B2
(45) Date of Patent: Feb. 20, 2018

(54) CRIMP TERMINAL

(71) Applicant: YAZAKI CORPORATION, Tokyo (JP)

(72) Inventor: Takaya Kondou, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/029,272

(22) PCT Filed: Oct. 16, 2014

(86) PCT No.: PCT/JP2014/077487

§ 371 (c)(1),
(2) Date: Apr. 14, 2016

(87) PCT Pub. No.: WO2015/056728

PCT Pub. Date: Apr. 23, 2015

(65) Prior Publication Data

US 2016/0233591 A1 Aug. 11, 2016

(30) Foreign Application Priority Data

Oct. 18, 2013 (JP) ..... 2013-216974

(51) Int. Cl.
*H01R 4/18* (2006.01)

(52) U.S. Cl.
CPC ..... *H01R 4/188* (2013.01); *H01R 4/185* (2013.01)

(58) Field of Classification Search
CPC ..... H01R 4/18; H01R 4/188; H01R 4/185
USPC ..... 439/877, 850–856
See application file for complete search history.

(56) References Cited

U.S. PATENT DOCUMENTS

| | | | |
|---|---|---|---|
| 3,892,459 | A | 7/1975 | Dittmann et al. |
| 3,990,143 | A | 11/1976 | Dittmann et al. |
| 2010/0230160 | A1 | 9/2010 | Ono et al. |
| 2010/0261391 | A1 | 10/2010 | Ono et al. |
| 2013/0126234 | A1 | 5/2013 | Ono et al. |
| 2013/0130570 | A1 | 5/2013 | Onuma et al. |
| 2013/0143454 | A1 | 6/2013 | Onuma et al. |

FOREIGN PATENT DOCUMENTS

| | | | |
|---|---|---|---|
| CN | 101842939 | A | 9/2010 |
| CN | 101842940 | A | 9/2010 |
| CN | 103053078 | A | 4/2013 |

(Continued)

OTHER PUBLICATIONS

Japanese Office action dated Jun. 6, 2017 in the counterpart Japanese patent application.

(Continued)

*Primary Examiner* — Harshad C Patel
(74) *Attorney, Agent, or Firm* — Metrolexis Law Group, PLLC

(57) ABSTRACT

A crimp terminal including a core-wire crimping section (16) for crimping a core wire of an electric wire including a plurality of strands includes serrations (18*a*, 18*b*) provided on a surface where the core wire of the core-wire crimping section (16) is to be crimped, small serrations (18*b*) are provided in a region to which a large crimping force is applied during a swaging and crimping process, and large serrations (18*a*) are provided in a region to which a small crimping force is applied.

12 Claims, 8 Drawing Sheets

(56) References Cited

FOREIGN PATENT DOCUMENTS

| | | | | | |
|---|---|---|---|---|---|
| CN | 103069660 | A | | 4/2013 | |
| DE | 19821630 | C1 | | 9/1999 | |
| JP | H10-125362 | A | | 5/1998 | |
| JP | 2009-123623 | A | | 6/2009 | |
| JP | 2010027464 | A | | 2/2010 | |
| JP | 2012-038486 | A | | 2/2012 | |
| WO | 2010/007843 | A1 | | 1/2010 | |
| WO | 2012/017800 | A1 | | 2/2012 | |
| WO | 2012/018050 | | * | 9/2012 | ..... H01R 4/18 |

OTHER PUBLICATIONS

Chinese Official Action dated May 3, 2017 in the counterpart Chinese patent application.
An office action dated Nov. 23, 2017 in a counterpart Chinese patent application.

* cited by examiner (a)

(b)

(c)

CRIMP TERMINAL

TECHNICAL FIELD

The present invention relates to a crimp mating terminal to an electric wire.

BACKGROUND ART

Various types of crimp terminals provided with serrations on a crimping surface have been suggested in the past (e.g., refer to Patent Literature 1). Such a crimp terminal of a conventional example is illustrated in FIGS. 6 to 8. In FIGS. 6 to 8, an electric wire W connecting a crimp terminal 110 includes a core wire 101 including a plurality of strands 101*a*, and an insulation outer skin 102 covering an outer circumference of the core wire 101. At a tip side of the electric wire W, the insulation outer skin 102 is removed and, thus, the core wire 101 is exposed.

The crimp terminal 110 includes a mating terminal connection section 111 and an electric-wire connection section 115. The electric-wire connection section 115 includes a core-wire crimping section 116 and an outer-skin crimping section 117. The core-wire crimping section 116 includes a base-bottom section 116*a* and a pair of swaging piece sections 116*b* extended from both sides of the base-bottom section 116*a*. On inner surfaces of the base-bottom section 116*a* of the core-wire crimping section 116 and the pair of swaging piece sections 116*b*, a number of serrations 118 that are circular recessed sections are formed. The serrations 118 all having a same dimension are arranged almost all over the inner surface of the core-wire crimping section 116. The outer-skin crimping section 117 includes a base-bottom section 117*a* and a pair of swaging piece sections 117*b* extended from both sides of the base-bottom section 117*a*.

In the crimp terminal 110, the exposed core wire 101 is swaged and crimped by the core-wire crimping section 116, and the insulation outer skin 102 is swaged and crimped by the outer-skin crimping section 117.

CITATION LIST

Patent Literature

Patent Literature 1: Japanese Patent Laid-Open Publication No. 2009-123623

SUMMARY OF INVENTION

Technical Problem

However, during a swaging and crimping process of the core-wire crimping section 116, crimping forces applied to the core-wire crimping section 116 are not uniform all over the regions. In other words, as illustrated in FIGS. 9(*a*), 9(*b*) and 9(*c*), there are a "region to which a large crimping force is applied" and a "region to which a small crimping force is applied" on the core-wire crimping section 116.

FIG. 9(*a*) is a vertical cross-sectional view (cross-sectional view of a face parallel to an axial direction of the core wire 101) schematically illustrating a direction in which forces from a swaging jig is applied and illustrating only the core-wire crimping section 116. As illustrated in FIG. 9(*a*), depending on a relative positional relationship from both ends of the core-wire crimping section 116 in the axial direction of the core wire 101, there are regions F0 and F2 where the forces from the swaging jig are concentrated during the swaging and crimping process on the core-wire crimping section 116. Further, in addition to the regions F0 and F2, there is a region F1 where forces applied between the core wire 101 and the core-wire crimping section 116 become stronger more than necessary. Positions of the regions F0, F1, and F2 are determined depending on a shape of the core-wire crimping section 116 and material of the core wire 101 and the like. The regions F0, F1 and F2 correspond to the "region to which a large crimping force is applied" described above. Further, the regions other than the regions F0, F1, and F2 on the core-wire crimping section 116 correspond to the "region to which a small crimping force is applied" described above.

As illustrated in FIGS. 9(*b*) and 9(C), serrations 118 provided in the "region to which a small crimping force is applied" have almost no stretch caused by rolling in local regions and keep a circular shape in a same size. However, serrations 118 provided in the "region to which a large crimping force is applied" are deformed into an oval shape due to large stretch caused by the rolling. As described above, when a size of the serrations 118 is changed, edges of the serrations 118 cannot be effectively used with respect to the stretch of the core wire 101, thereby suppressing the stretch of the core wire 101. Thus, there used to be a problem in which, since adhesion among the respective strands 101*a* cannot be efficiently obtained, conduction characteristics between the strands 101*a* are not improved and, thus, electric resistance at crimping positions is increased.

The present invention has been made for solving the above-described problems, and an object is to provide a crimp terminal in which the electric resistance at the crimping position of the electric wire can be reduced.

Solution to Problem

A crimp terminal of the present invention is a crimp terminal including a core-wire crimping section for crimping a core wire of an electric wire including a plurality of strands, wherein first serrations are provided in a first region of the core-wire crimping section on a surface onto which the core wire is to be crimped, and wherein second serrations smaller than the first serrations are provided in a second region of the core-wire crimping section on the surface onto which the core wire is to be crimped, and to which a crimping force larger than that in the first region is applied during a swaging and crimping process.

In the crimp terminal according to the present invention, the first serrations or the second serrations may be circular recessed sections.

DESCRIPTION OF EMBODIMENTS

With reference to figures, an embodiment according to the present invention will be described below.

Figure 1:
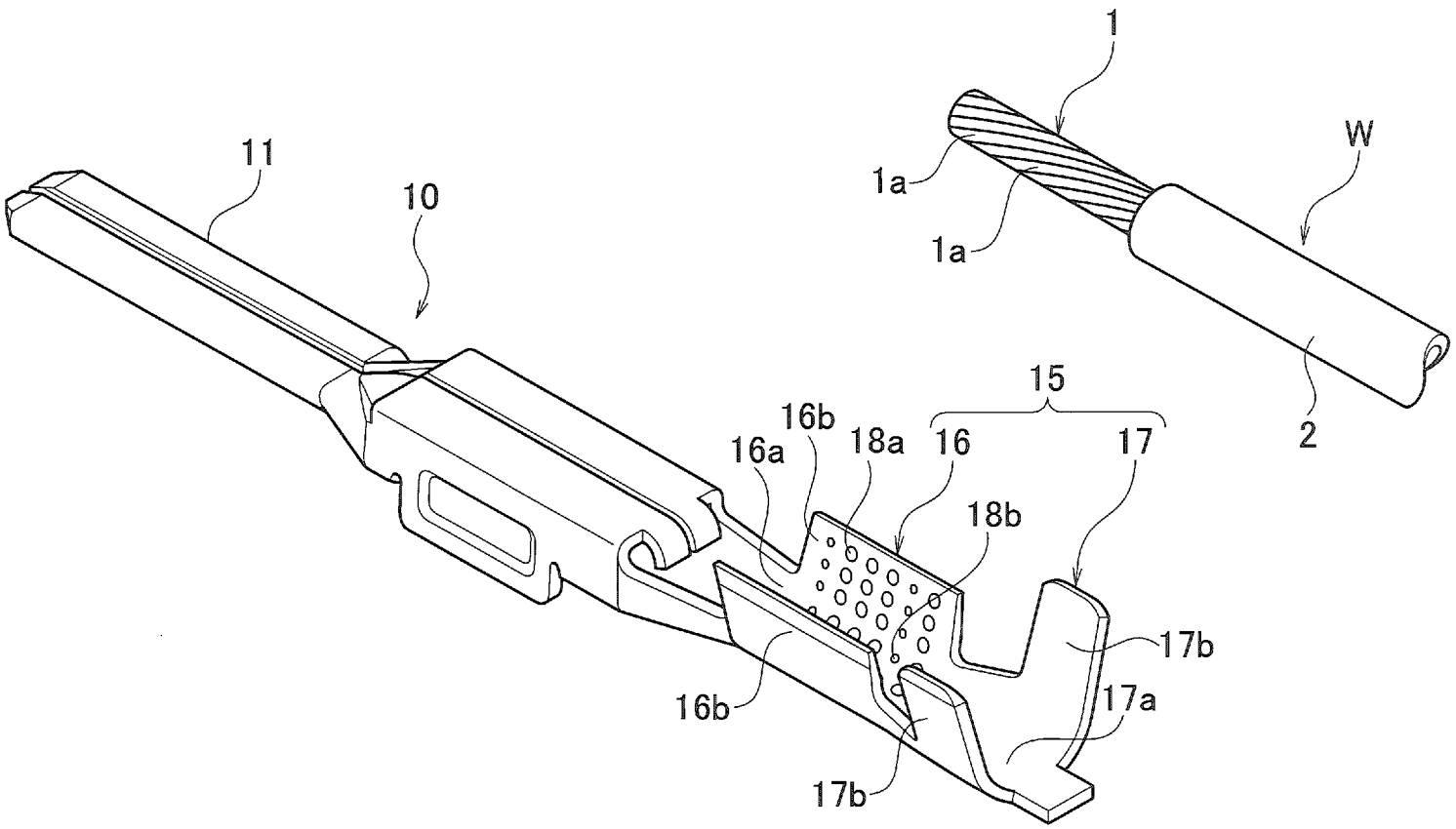
FIG. 1 is a perspective view of a crimp terminal before an electric wire is crimped thereto of an embodiment according to the present invention.
Figure 2:
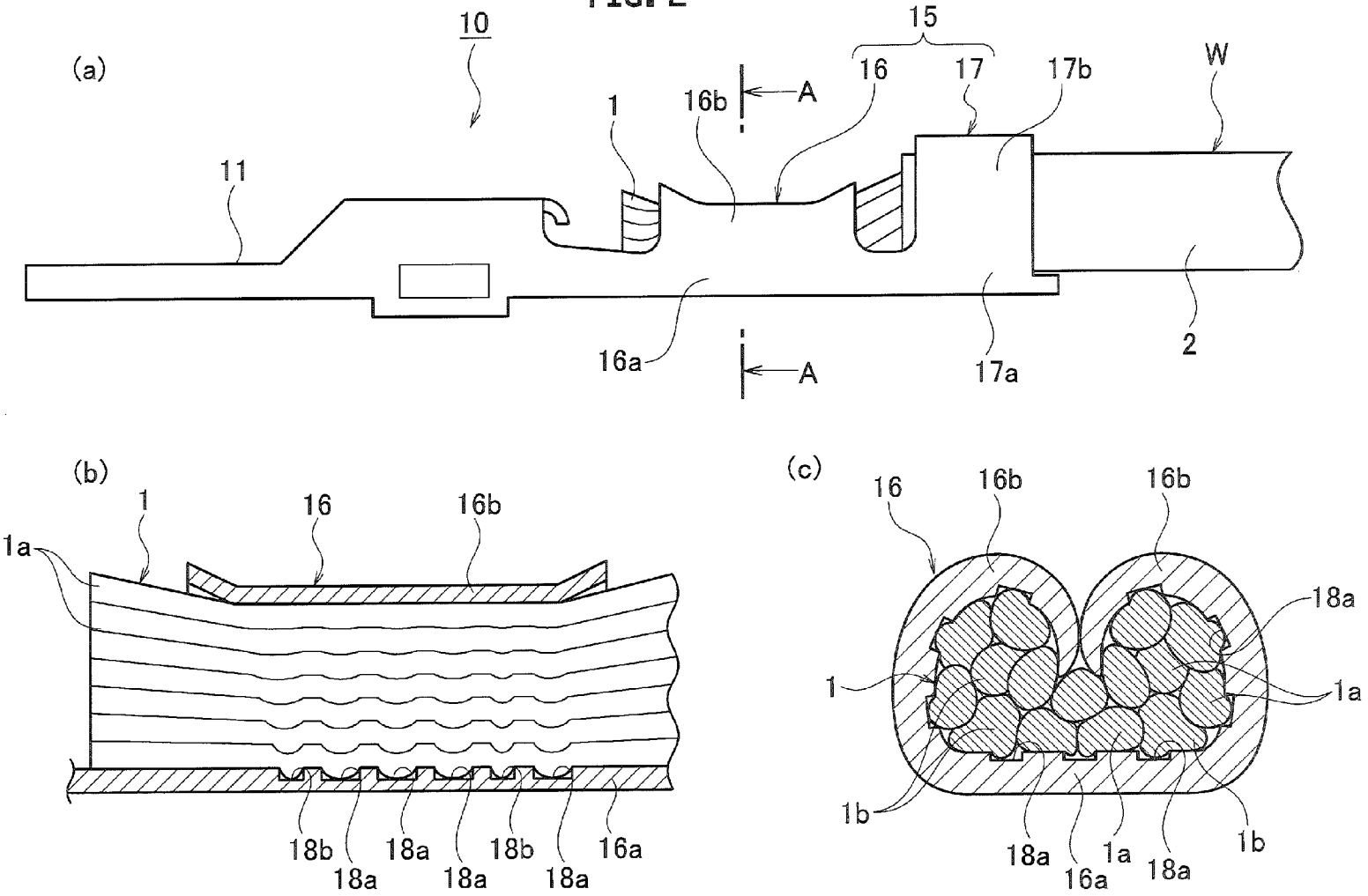
FIGS. 2(*a*), 2(*b*) and 2(*c*) illustrate an embodiment according to the present invention, in which FIG. 2(*a*) is a side view of the crimp terminal onto which the electric wire is crimped, FIG. 2(*b*) is a vertical cross-sectional view of a core-wire crimping section, and FIG. 2(*c*) is a cross-sectional view taken along a line A-A in FIG. 2(*a*).

FIGS. 1 to 5 illustrate the embodiment according to the present invention. As illustrated in FIGS. 1 and 2, the electric wire W includes a core wire 1 including a plurality of strands 1*a* and an insulation outer skin 2 covering an outer circumference of the core wire 1. At a tip side of the electric wire W, the insulation outer skin 2 is removed and, thus, the core wire 1 is exposed. The core wire 1 includes a number of strands 1*a* made of aluminum or aluminum alloy (hereinafter referred to as "made of aluminum," and a number of the strands 1*a* are twisted with each other. In other words, the electric wire W is an aluminum electric wire.

The crimp terminal 10 is, for example, made of copper alloy and formed by bending a plate cut into a predetermined shape. The crimp terminal 10 includes a mating terminal connection section 11 and an electric-wire connection section 15. The electric-wire connection section 15 includes a core-wire crimping section 16 and an outer-skin crimping section 17.

The core-wire crimping section 16 includes a base-bottom section 16*a* and a pair of swaging piece sections 16*b* extended from both sides of the base-bottom section 16*a*. On inner surfaces of the base-bottom section 16*a* of the core-wire crimping section 16 and the pair of swaging piece sections 16*b* (surfaces onto which the core wire 1 is crimped), a number of the serrations 18*a*, 18*b* that are a number of circular recessed sections are provided in a dotted manner almost all over the region. Configurations of the serrations 18*a*, 18*b* will be described in detail below.

The outer-skin crimping section 17 includes a base-bottom section 17*a* and a pair of swaging piece sections 17*b* extended from both sides of the base-bottom section 17*a*.

In the crimp terminal 10, the exposed core wire 1 is swaged and crimped by the core-wire crimping section 16, and the insulation outer skin 2 is also swaged and crimped by the outer-skin crimping section 17.

Figure 3:
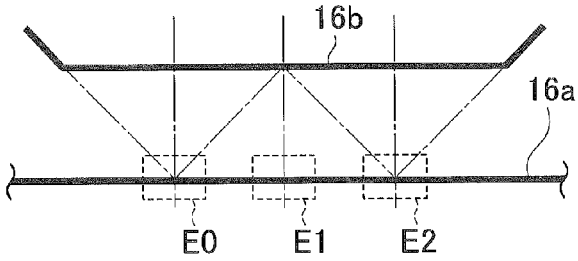
FIGS. 3(*a*), 3(*b*) and 3(*c*) illustrate an embodiment according to the present invention, in which FIG. 3(*a*) is a vertical cross-sectional view of the core-wire crimping section that schematically illustrates a direction in which a force from a swaging jig is applied, FIG. 3(*b*) is an exploded view of the core-wire crimping section before crimping, and FIG. 3(*c*) is an exploded view of the core-wire crimping section after the crimping.
Figure 3:
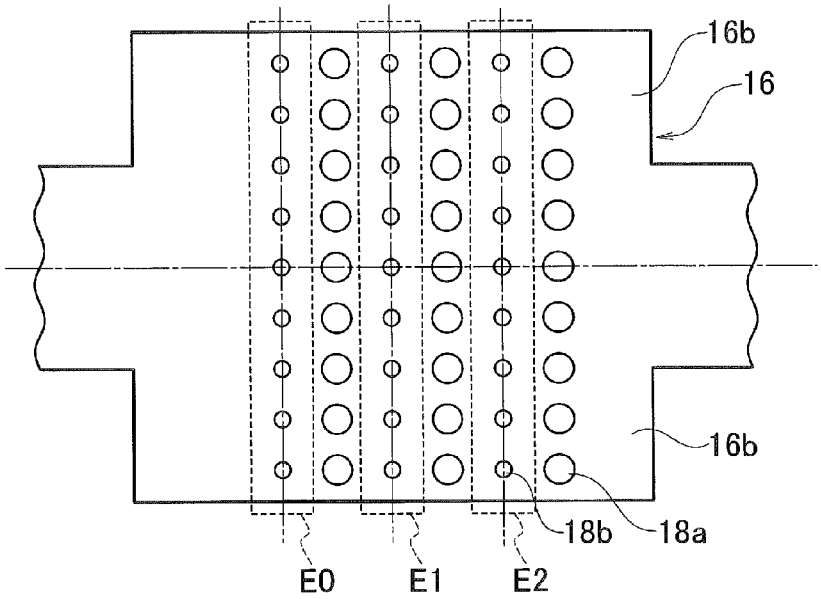
Figure 3:
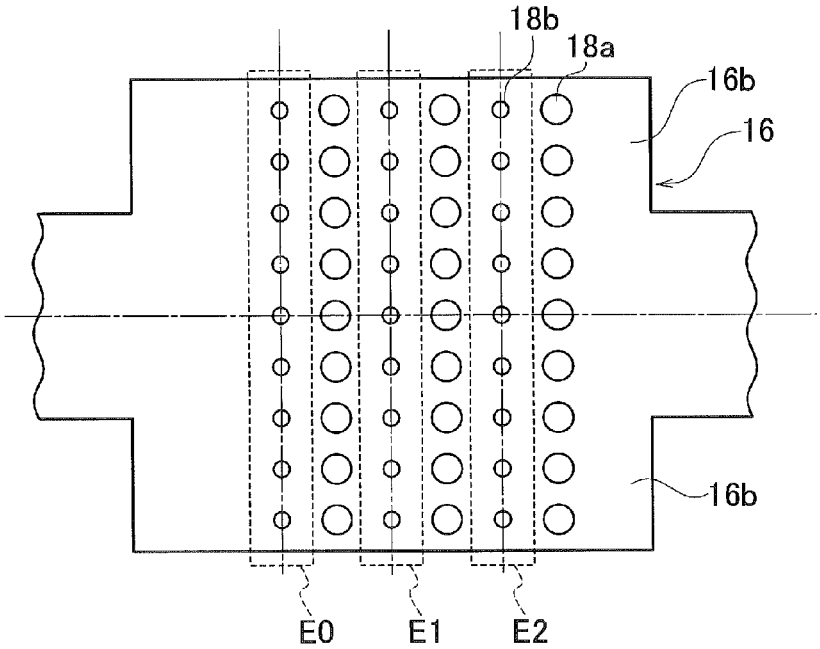

Subsequently, the serrations 18*a*, 18*b* will be described. As illustrated in FIG. 3(*b*), the serrations 18*a*, 18*b* are provided at almost equal intervals along an axial direction of the core wire 1 almost all over the region on the inner surface of the core-wire crimping section 16. The serrations 18*a*, 18*b* are circular recessed sections. The serrations 18*a*, 18*b* are provided such that the large serrations 18*a* (first serrations) are arranged in a region to which a small crimping force is applied during the swaging process, and a small serrations 18*b* (second serrations) are arranged in a region to which a large crimping force is applied during the swaging process.

The large serrations 18*a* (first serrations) are larger in a size than the small serrations 18*b* (second serrations). A size of the serrations refers to a diameter of the serrations or a depth thereof.

As illustrated in FIG. 3(*a*), the regions to which the large crimping force is applied during the swaging process are regions E0, E2 about a position where an auxiliary extending line at an angle of 45 degrees from both end positions of a swaging jig 20 intersects with the base-bottom section 16*a*. The small serrations 18*b* are provided in the regions E0, E2. Further, in addition to the regions E0, E2, there is a region E1 where forces applied between the core wire 1 and the core-wire crimping section 16 become stronger more than necessary. When the core wire 1 is made of aluminum as in the present embodiment, compared to the core wire 1 made of the copper alloy, the core wire 1 is further overly crimped in the region E1. In the region E1 also, the small serrations 18*b* are provided. The positions of the regions E0, E1, E2 are determined depending on a shape of the core-wire crimping section 16 and material of the core wire 1.

Of the surfaces of the core-wire crimping section 16 onto which the core wire 1 is crimped, in the regions other than the regions E0, E1, E2, the small crimping forces are applied during the swaging process and, thus, the large serrations 18*a* are provided.

Of the surfaces of the core-wire crimping section 16 onto which the core wire 1 is crimped, the regions other than the regions E0, E1, E2 are the "region to which a small crimping force is applied" (first regions). Of the surfaces of the core-wire crimping section 16 onto which the core wire 1 is crimped, the regions indicated with the regions E0, E1, E2 correspond to the "region to which a large crimping force is applied" (second regions). The crimping force applied to the first region is smaller than that applied to the second region.

In other words, of the surfaces of the core-wire crimping section 16 onto which the core wire 1 is crimped, in the regions other than the regions E0, E1, E2 (first regions), the serrations 18*a* (first serrations) are provided. On the other hand, in the regions E0, E1, E2 (second regions) to which the larger crimping force is applied compared to the regions other than the regions E0, E1, E2 during the swaging and crimping process, the serrations 18*b* (second serrations) are provided.

Figure 4:
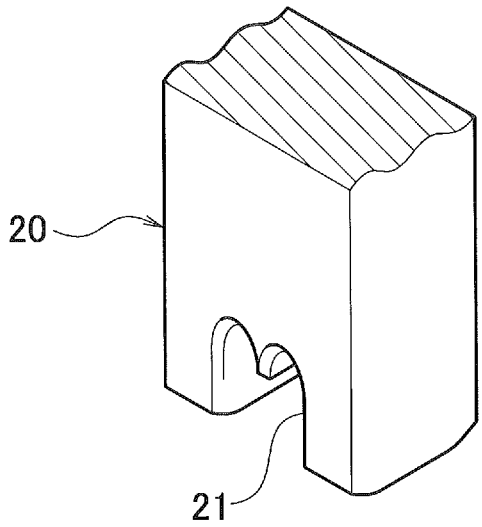
FIG. 4 is a perspective view of a swaging jig of an embodiment according to the present invention
Figure 5:
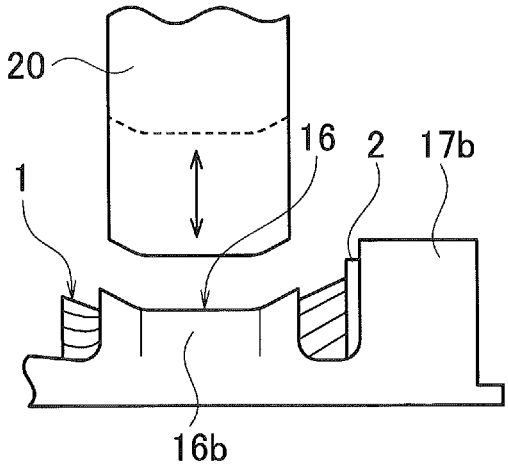
FIG. 5 is a side view illustrating a swaging work with the swaging jig of the embodiment according to the present invention.
Figure 6:
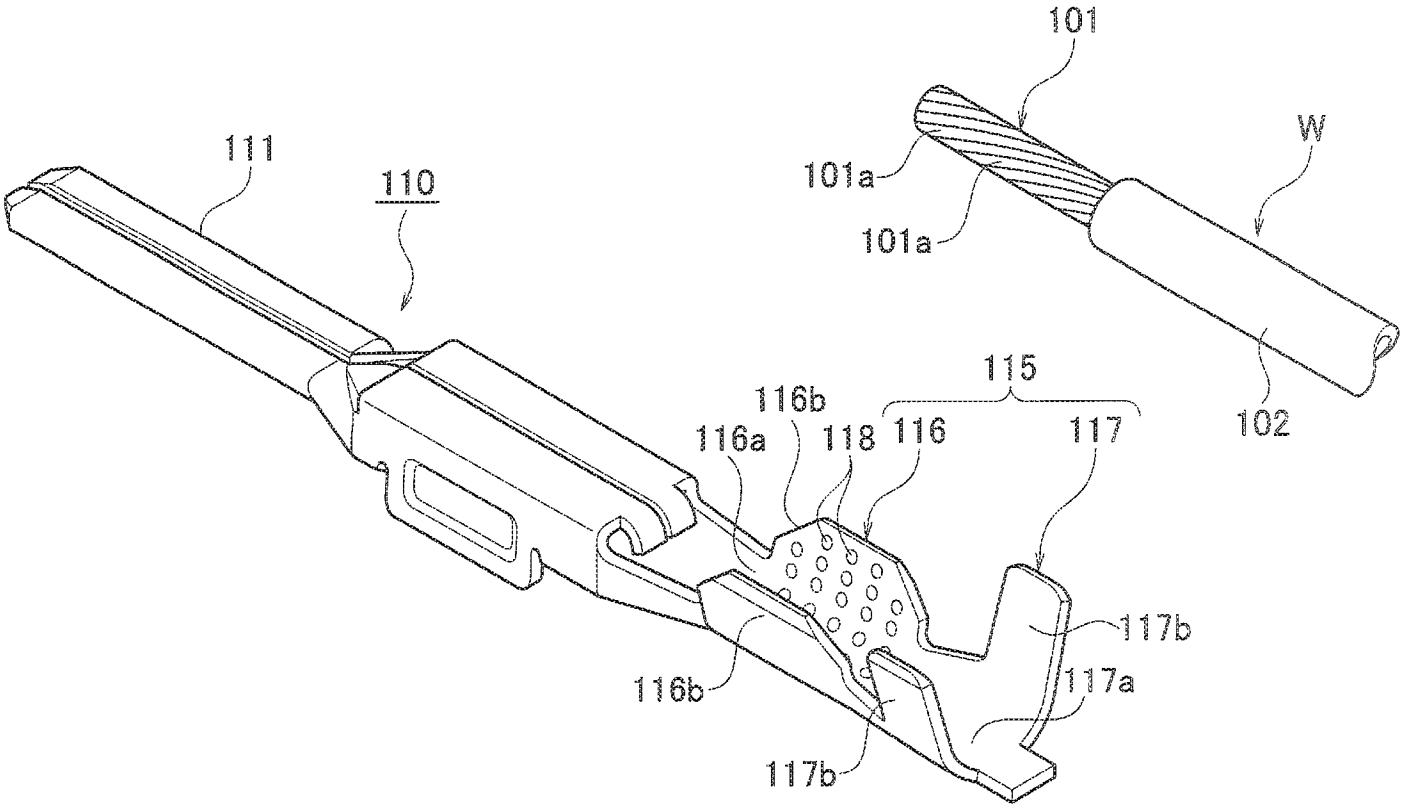
FIG. 6 PRIOR ART
FIG. 6 is a perspective view of the crimp terminal before the electric wire is crimped thereto according to a conventional example.
Figure 7:
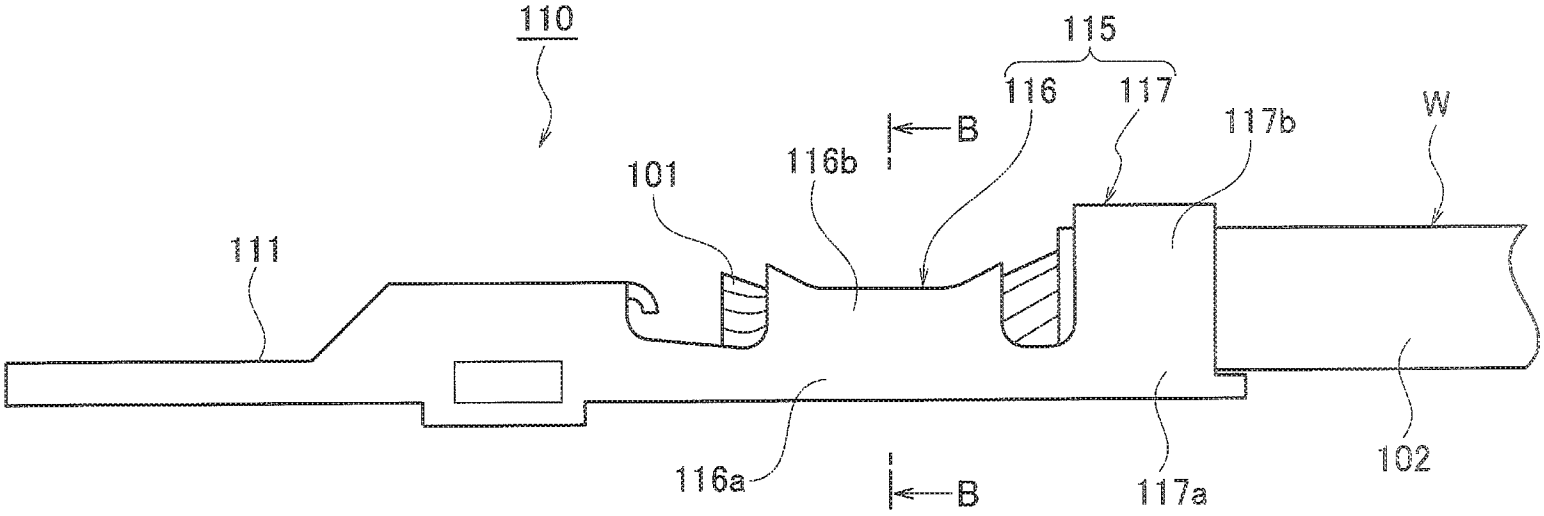
FIG. 7 PRIOR ART
FIG. 7 is a side view of the crimp terminal to which the electric wire is crimped according to the conventional example.
Figure 8:
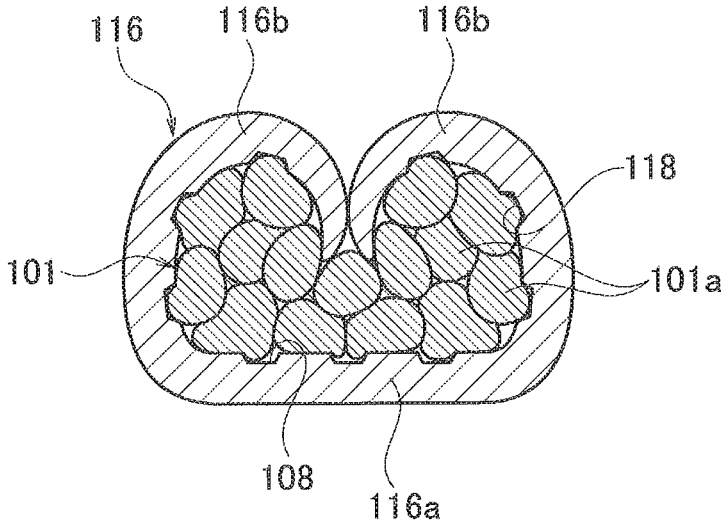
FIG. 8 PRIOR ART
FIG. 8 is a cross-sectional view taken along a line of B-B in FIG. 7 according to the conventional example.
Figure 9:
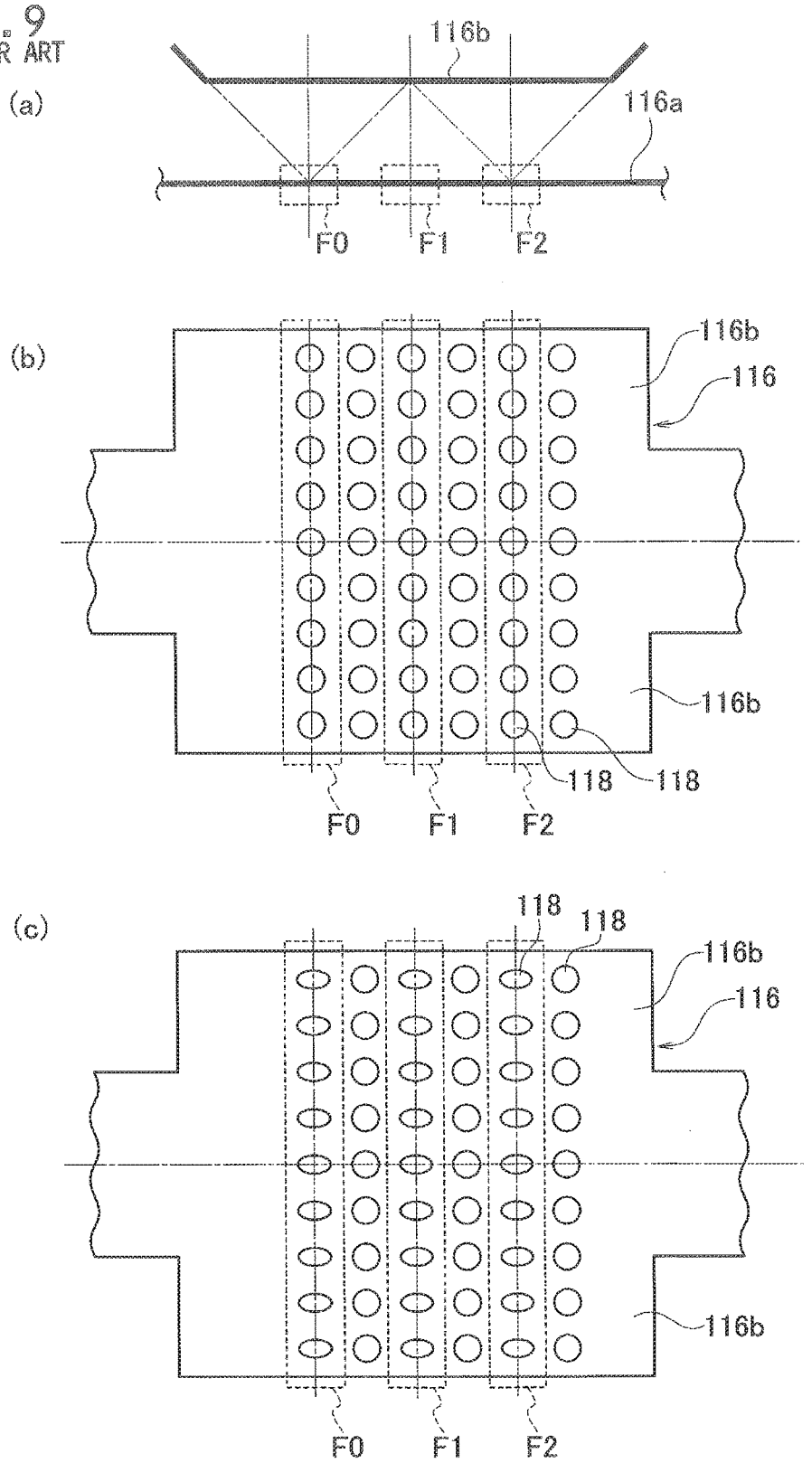
FIG. 9 PRIOR ART
FIGS. 9(*a*), 9(*b*) and 9(*c*) illustrate the conventional example, in which FIG. 9(*a*) is a vertical cross-sectional view of only the core-wire crimping section that schematically illustrates a direction in which a force from a swaging jig is applied, FIG. 9(*b*) is an exploded view of the core-wire crimping section before crimping, and FIG. 9(*c*) is an exploded view of the core-wire crimping section after the crimping.

The crimp terminal 10 is crimped by the swaging jig 20 illustrated in FIG. 4. The swaging jig 20 includes a swaging groove 21 having an outer circumferential shape of final swaging at a swaging tip side. As illustrated in FIG. 5, when the pair of core-wire swaging piece sections 16*b* are pressed from above by the swaging jig 20, the pair of swaging piece sections 16*b* are plastic-deformed along the swaging groove 21.

During the swaging and crimping process, the core wire 1 receives the crimping forces from the core-wire crimping section 16 and, accordingly, each of the strands 1*a* of the core wire 1 gets into the serrations 18*a*, 18*b* so that the strands 1*a* is stretched to generate a newly born surface.

Further, during the swaging and crimping process, the large crimping force is applied to the regions E0, E1, E2

(second regions) including the small serrations 18*b* (second serrations). However, since the regions E0, E1, E2 (second regions) include a large thick region (region other than serrations 18*b*), almost no stretch is generated by the rolling, and thus deformation of the serrations 18*b* can be suppressed.

On the other hand, in the regions of the large serrations 18*a* (first serrations), in other words, in the regions (first regions) other than the regions E0, E1, E2, since only small crimping force is applied, even if there is the large thin region (the region of the serrations 18*a*), almost no stretch is generated by the rolling, and thus the serrations 18*a* are not deformed.

As described above, since the deformation of the serrations 18*a*, 18*b* can be suppressed, edges of the serrations 18*a*, 18*b* can be effectively used with respect to the stretch of the core wire 1 to promote the stretch thereof. With this arrangement, the adhesion among the strands 1*a* can be efficiently obtained to improve the conduction characteristics between the strands 1*a*, thereby reducing the electric resistance at the crimping point.

Further, since the each of the strands 1*a* gets into the serrations 18*a*, 18*b*, tensile strength between the core wire 1 and the core-wire crimping section 16 can be improved (mechanical strength is improved).

As described above, design of a part of the crimp terminal 10 is changed (size change of the serrations) to improve the conduction characteristics of the core wire 1 at the crimping point. Therefore, the electric resistance at the crimping point can be reduced without raising costs compared to making the core wire into a single line.

The core wire 1 is made of aluminum. An oxidized film produced on a surface of the strands 1*a* and made of the aluminum is harder compared to that of the copper alloy. Therefore, the core wire 1 made of the aluminum used to have a problem of an increase of the electric resistance due to the conduction resistance between the strands 1*a*. However, according to the present invention, since the conduction resistance between the strands 1*a* can be reduced, the present invention is effective particularly for the aluminum electric wire. The core wire 1 made of aluminum is softer and stretched more easily compared to that made of copper alloy. However, as described above, since stress transferring loss from the core-wire crimping section 16 to the core wire 1 can be reduced, the present invention is effective particularly for the aluminum electric wire also from this point of view.

According to the embodiment, the serrations 18*a*, 18*b* are the circular recessed sections, however, of course, they may be recessed sections having other shapes (oval, triangle, square (including diamond), polygonal shape including more than four sides, and a star-like shape).

According to the embodiment, the core wire 1 is made of aluminum, however, the present invention can be applied to the core wire 1 made of material other than aluminum (e.g., made of copper alloy). When the core wire is made of copper alloy, the serrations provided in the region E1 illustrated in FIG. 3(*b*), FIG. 3(*c*) are made in a large size.

The embodiment according to the present invention described as above is only an example described for easier understanding of the present invention, and the present invention is not limited to the embodiment described above. The technical aspect of the present invention is not limited to specific technical items disclosed in the above described embodiment, but include various changes, modifications, and alternative techniques that can be easily directed from the above described embodiment.

The present application claims the priority based on Japanese Patent Application No. 2013-216974 filed on the Oct. 18, 2013, and the whole contents of the application are incorporated into the present specification as reference.

INDUSTRIAL APPLICABILITY

According to the present invention, during the swaging and crimping process, the large crimping force is applied to the region of the small serrations. However, since the thin region (other region of small serrations) is large, almost no stretch is generated by the rolling, and thus deformation of the serrations can be suppressed. On the other hand, in the region of the large serrations, since only small crimping force is applied, even if the thin region (region of the large serrations) is large, almost no stretch is generated by the rolling, and the serrations are not deformed. As described above, since the deformation of the serrations can be suppressed, the edges of the serrations can be effectively used with respect to the stretch of the core wire, thereby promoting the stretch of the core wire. With this arrangement, the adhesion among the strands can be efficiently obtained to improve the conduction characteristics between the strands, thereby reducing the electric resistance at the crimping point.

REFERENCE SIGNS LIST

W electric wire
1 core wire
1*a* strand
10 crimp terminal
16 core-wire crimping section
18*a* large serration (first serration)
18*b* small serration (second serration)

The invention claimed is:

1. A crimp terminal comprising a core-wire crimping section for crimping a core wire of an electric wire including a plurality of strands, wherein first serrations are provided in a first region of the core-wire crimping section on a surface onto which the core wire is to be crimped with a first crimping force, a size of the first serrations is set in accordance with the first crimping force, wherein second serrations smaller than the first serrations are provided in a second region of the core-wire crimping section on the surface onto which the core wire is to be crimped with a second crimping force, a size of the second serrations is set in accordance with the second crimping force, wherein the second crimping force in the second region is larger than the first crimping force in the first region, the first crimping force and the second crimping force being applied during a swaging and crimping process, and the size of the second serrations is set smaller than the size of the first serrations based on the second crimping force being larger than the first crimping force, and wherein a plurality of the first region of the core-wire crimping section provided with the first serrations and a plurality of the second region of the core-wire crimping section provided with the second serrations are alternately arranged at equal intervals along an axial direction of the core wire.

2. The crimp terminal according to claim 1, wherein the first serrations and the second serrations are circular recessed sections.

3. The crimp terminal according to claim 1, wherein the plurality of strands is made of aluminum or aluminum alloy.

4. The crimp terminal according to claim 1, wherein the plurality of strands is made of copper or copper alloy.

5. The crimp terminal according to claim 1, wherein strands of the plurality of strands are twisted.

6. The crimp terminal according to claim 1, wherein the first serrations and the second serrations are provided at substantially equal intervals along the axial direction of the core wire.

7. The crimp terminal according to claim 1, wherein the first serrations are larger in one of: a diameter; and a depth, than the second serrations.

8. The crimp terminal according to claim 1, wherein first region comprises all regions of the core-wire crimping section other than the second region where the second crimping force larger than the first crimping force is applied during the swaging and crimping process.

9. The crimp terminal according to claim 1, wherein the first serrations and the second serrations comprise oval shaped recessed sections.

10. The crimp terminal according to claim 1, wherein the first serrations and the second serrations comprise triangle shaped recessed sections.

11. The crimp terminal according to claim 1, wherein the first serrations and the second serrations comprise polygonal shaped recessed sections.

12. The crimp terminal according to claim 1, wherein the first serrations and the second serrations comprise star shaped recessed sections.

* * * * *